United States Patent [19]

Miyada

[11] Patent Number: 4,698,844

[45] Date of Patent: Oct. 13, 1987

[54] ANTI-CRIME SPIKE-NEEDLE

[76] Inventor: Thomas S. Miyada, P.O. Box 430, Summit, N.J. 07901

[21] Appl. No.: 738

[22] Filed: Jan. 5, 1987

[51] Int. Cl.[4] ..... A41D 13/00

[52] U.S. Cl. ..... 2/1

[58] Field of Search ..... 2/1, 2, 2.5

[56] References Cited

U.S. PATENT DOCUMENTS 1,109,264 9/1914 Teeple ..... 2/1

*Primary Examiner*—Louis K. Rimrodt

*Attorney, Agent, or Firm*—Thomas Sanfran Miyada

[57] ABSTRACT

An anti-crime device, known as the Anti-crime Spike-needle, is an inconspicuous device that is attachable in any quantity to fur-coats and other garments and articles, and is harmless to the wearers and users of such garments and articles, but it can sting and injure anyone who uses force or unnecessarily heavy pressure to hold, pull, push, detain, or strike the wearer or the user thereof. Its main components consist of a spike-needle and a hair-like resilient steel wire, the former's needle-sharp point is prevented from touching anyone who is friendly by the latter which encircles or stands next to the former. When a pressure greater than normal or friendly is applied on the garment or other article equipped with the device, such as by a criminal, the resilient hair-like wire or wires yield and expose the sharp point of the spike-needle and discourage and even stop any further overt act against the wearer or user thereof.

4 Claims, 7 Drawing Figures

ANTI-CRIME SPIKE-NEEDLE

BACKGROUND OF THE INVENTION (1) Field of the Invention

Individual Safety Device, General Personal Protection, Protective Device for Garments, etc.

(2) As far as known to this applicant, there appears to be no prior art closely resembling this invention.

SUMMARY

The main purpose of this invention is to provide protection for women, children, and even men, who frequently use lonely sidewalks, paths, alleys, elevators, subways, and parks, and who do not have the strength to resist being robbed, or pulled into alleyways and cars and attacked by criminals. As long as a criminal does not succeed in holding or detaining his intended victim, especially by the latter's arm, the intended victim could walk away or even strike back. This invention prevents any criminal from holding the sleeves and arms or any other part of a person's garment that may serve as a sort of a "handle".

The invention is attachable to fur coatas, chenille and other garments. For this reason this invention also has another valid and useful purpose. Fur coats and chenille garments with deep or long piles can not only keep the winter cold out, but also can greatly reduce the entry of summer heat and strong ultra-violet rays that accelerate the aging process. Nature has been partial to lower animals by endowing them with furs to keep the cold out in the winter and heat out in the summer. This invention will not only help protect the wearer of fur and pile-lined garments, but will also make the wearing of such garments in hot weather just as stylish and healthful as in the winter.

In the preferred embodiment, the invention is made of two principal sections (a) a cylindrical holder mounted on a base and a plurality of hair-like wires attached to the side of the holder; and (b) a lower section consisting of a spike-needle, so-called since its bottom part looks like a small spike and its top resembles a comparatively large needle, and a holding disc. Section (b) is inserted from the reverse side of the fur or chenille garment so that the spike-needle will pass through the bottom opening of the holder "a" which is placed on the obverse side of the garment, and then "b" is screwed into "a" until it is quite tight. A dozen or even a hundred of the devices can be attached to the garment.

The spike-needles do not sting anyone who gently or friendly leans against or touches the wearer of the garment equipped with the devices due to the presences of flexible hair-like steel wires. They are safe to the wearer and his or her friends. But if anyone forcefully holds, violently strikes, or strongly pulls or pushes the wearer, the hair-like helical and wavy steel wires yield and expose the sharp points of the spike needles that can sting deeply.

It is quite important to point out that assailant wearing the conventional gloves is not immune since the sharp needles could easily go through leather. Even a criminal wearing double-thick, multiple-layered gloves or several gloves to avoid the needle-sharp points can be still stopped because he cannot grab tightly or hold firmly the intended victim's sleeves or other parts with a very thick clumsy gloves. An intended victim can easily get loose from such a clumsy grip and can strike back by swinging his or her spiked sleeves and arm.

Needless to say, the device does not prevent all crimes, but it deters many criminal acts.

DRAWINGS

DESCRIPTION OF THE PREFERRED EMBODIMENT

Figure 1:
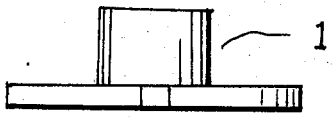
FIG. 1 is an enlaraged view of the cylindrical holder.
Figure 2:
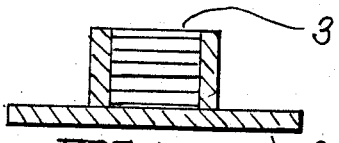
FIG. 2 is an enlarged view of the cross section of the one shown in FIG. 1 and revealing the internal threading.
Figure 3:
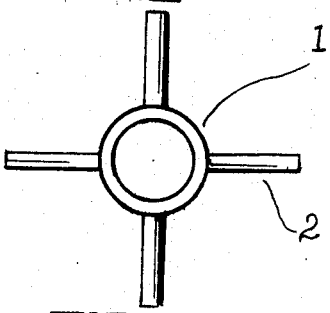
FIG. 3 is a plan view of the holder and its base shown in FIG. 1.
Figure 4:
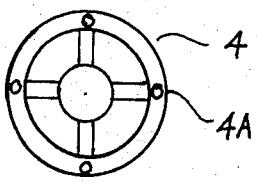
FIG. 4 is a plan view of the holding base of the embodiment shown in FIG. 11.

The preferred embodiment of this invention comprises of two sections:

(1) Section One consists of those parts of the invention that are placed or located on the outer or obverse side of a fur coat, chenille garment, ordinary clothes, and articles. (Shown in FIG. 6) and (2) Section Two consists of those parts of the invention that are placed or located in the under or reverse side of the fur coat, chenille garment and other fabrics, and also the part piercing through the garment. (Shown in FIG. 5)

Section One comprises of (a) a holder in the form of a short cylinder 1 having its cylindrical hollow internally threaded 3; (b) a cross-shaped base 2 evenly positioned and attached securely to the bottom of the holder; and (c) a plurality of straight, wavy and curly hair-like resilient steel wires 6, their bottom section attached to the side of the said holder or to the exposed arms of the said base, and their top ends reaching to a height of the hair or pile on the garment 11 or to an inch or less height in the absence of the fur or pile.

Section Two comprises of (a) a flat disc 7 with milled edge; and (b) a spike-needle 5 whose bottom end securely attached to the center of the said disc, whose lower section externally threaded 5A to fit the internal threading in the cylindrical holder described above, and whose height or length limited to about two thirds of the height or length of the said hair-like steel wires.

The spike-needle 5, a sort of a hybrid between a small spike and a large needle, has no "eye", but a slightly flat or blunt base so that it could be welded or securely attached to the center of the said disc 7.

The hair-like steel wires 6 used in this invention are resilient and could stand vary-pressures on their top ends from about half a pound to four or more pounds. In the preferred embodiment they are made to bend or yield at an average pressure of two pounds. the steel wires used are, of course, much thicker than the natural animal hairs in order to stand the required pressures on their tips, and are made in various shapes. The term "hair-like wire" or its plural as used throughout in this application and claims is intended to mean a resilient steel wire having the shape of a straight, wavy, curly, or helical animal hair.

Figure 5:
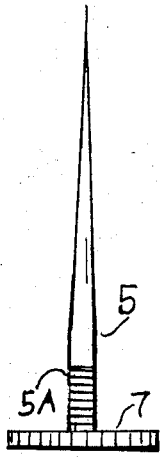
FIG. 5 is an enlarged view of the spike-needle used in the preferred embodiment.
Figure 6:
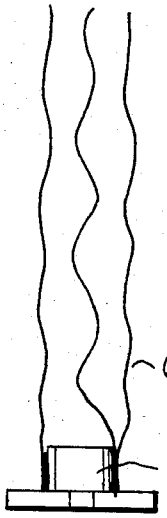
FIG. 6 is an enlarged view of the cylindrical holder with its hair-like steel wires.
Figure 7:
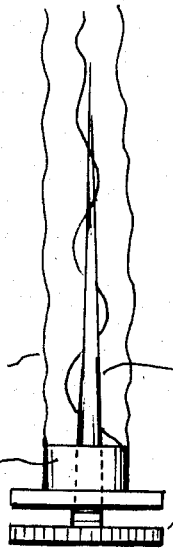
FIG. 7 is an enlarged view of the completely assembled preferred embodiment.
Figure 8:
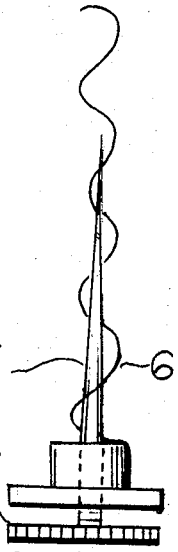
FIG. 8 is an enlarged view of the preferred embodiment with only the curly hair-like wire encircling the spike-needle.
Figure 9:
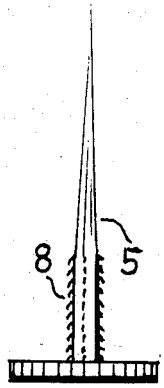
FIG. 9 is an enlarged view of the spike-needle with fin-like steel projections jutting out from its side.

The preferred embodiment has a holder, shown in FIG. 1, and a spike-needle 5 securely attached to the disc as shown in FIG. 5. The hair-like steel wire or wires are attached to the holder 1 as seen in FIG. 6. The completely assembled preferred embodiment is illustrated in FIG. 7.

VARIATIONS

Figure 10:
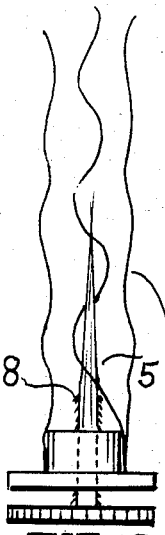
FIG. 10 is an enlarged view of the spike-needle shown in FIG. 9 properly positioned through the section shown in FIG. 6 and designated as the first variation on the preferred embodiment.

The first of the related variation is shown in FIG. 10. It is similar to the preferred embodiment, except that it has many fin-like projections that jut out from the lower section of the spike-needle and has no threadings (9).

In attaching to a fur coat or other garment, the spike-needle is inserted from the reverse side of the garment and pushed through the cylindrical passageway in the holder 1 until the fin-like projections 8 on the bottom section of the spike needle pass the cylindrical holder's top rim where the fin-like projections catch the rim and lock the needle in position. (FIG. 10).

Figure 11:
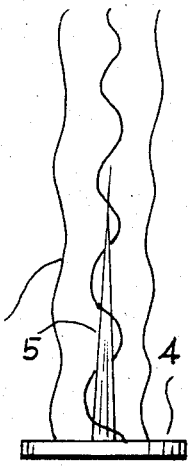
FIG. 11 is an enlarged view of the second variation of the preferred embodiment.

The second variation is shown in FIG. 11. The hair-like steel wires 6 and the spike-needle 5 are mounted on a base 4 having the shape resembling a conventional button provided with holes 4A large enough for sewing needle and thread to go through. This variation is placed on the obverse side of a fur, chenille, and other garment, and then its button-like base is sewed unto the garment 11. The spike-needle used in this variation is similar to those used in the preferred embodiment, except that its bottom section is not threaded.

Figure 12:
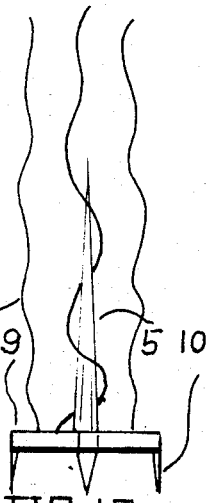
FIG. 12 is an enlarged view of the third variatin of the preferred embodiment.
Figure 13:
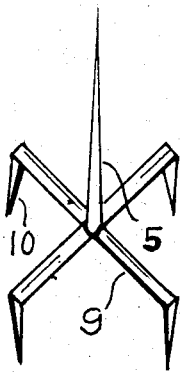
FIG. 13 is the enlarged view of the holding base of the third variation.
Figure 14:
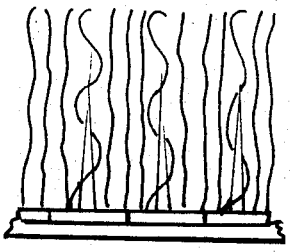
FIG. 14 is a view of the devices joined together by their bases.
Figure 15:
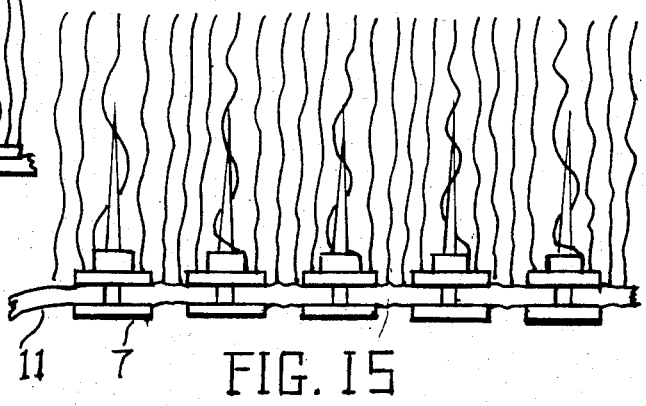
FIG. 15 is that of the schematic cross-section of a collection of the devices attached to a fabric and showing their own hair-like wires and the natural hairs rising from the exposed surface of the fabric.

The third variation of this invention is shown in FIG. 12. It has at least one curly hair-like steel wire and a spike-needle mounted and securely attached to the center of a metallic base 9, which is made in the shape of a cross with the four ends of the cross bent 45 degrees downward and sharpened 10. The spike-needle used in this variation is similar to those used in the preferred embodiment, except it has no threading on its bottom section. This particular version of the invention can be attached to the garment or other article from the obverse side by pushing its base against and through the garment or article, and bending the penetrated projections until they become parallel to the reverse surface of the garment or article.

The attachment of the preferred embodiment and its several versions to the garment may be scattered at random, concentrated in number on the sleeves and other parts, or even positioned to form a specific pattern so that the points of the spike-needles will leave an identifying needle marks on the assailant's hands and arms.

In the third and fourth versions of the invention described hereinabove, the spike-needle need not have a comparatively large base or lower section, and can be streamlined like a smooth body of a large needle if it is so desired. In this case, the "eye", the threading hole, will not be there.

I claim:

1. An anti-crime device that is attachable to the obverse side of a fur coat, chenille and other garment that does not harm the wearer of such garment but that stings and injures anyone who forcefully holds or attacks the wearer of such garment, said device comprising in combination the following two sections and their parts:

(a) a top section having (a1) a short cylindrical tube, called holdler, with an internally threaded cylindrical hollow that extends through its full length, (a2) a plurality of hair-like steel wires having their lower section welded and securely attached to the external surface of the wall of the said holder, and their top sections extending straight upward several times the height of the said holder, and (a3) a cross-shaped base welded and securely attached to the bottom of the said holder with the four ends of the cross-shaped base protruding in equal length from the side of the holder; and (b) a bottom section consisting of (b1) a spike-needle, an article having a bottom section that resembles a small spike and a top section that looks like a sharp needle, having its bottom section externally threaded and its top section made smooth and to taper off to a sharp point, said point never exceeding the height of the hair-like steel wires described hereinabove, (b2) a disc holding securely to its obverse side by means of welding the bottom end of the said spike-needle, and the two sections becoming an operable unit by the insertion of the needle sharp point of the section "b" through the garment from the reverse side, then into the threaded center of the holder of section "a" on the obverse side of the garment, and lastly being screwed in tightly.

2. An anti-crime device, which is attachable on the obverse side of a furred, piled and other garments and also on non-wearing articles, and which does not harm the wearer of such garment or user of such article, but which stings and injures anyone who forcefully holds, pushes, pulls, attacks or detains the wearer or the user thereof, said device comprising, in combination, the following two sections and their parts:

(a) a top section comprising (a1) a short cylindrical holder having a cylindrical hollow extending through its full length, (a2) a base having the shape of a cross and centered under the said holder and welded securely thereto, and possessing (a3) at least one curly hair-like steel wire securely attached to the external surface of the said cylindrical holder's wall; and (b) a bottom section comprising (b1) a spike-needle having a lower part resembling that of a small spike and an upper section resembling that of a large needle without the traditional "eye", said spike-needle not exceedidng the height of the hair-like steel wire described hereinabove, (b2) a plurality of small fin-like projections jutting out from the surface of the lower section of the spike-needle, (b3) a disc holding securely to its obverse center by means of welding the bottom end of the said spike-needle;

and the said two sections becoming operable by inserting the needle-sharp point of Section "b" from the reverse side of the garment, then into the cylindrical hollow of the said holder on the obverse side of the garment and pushing it further in until the fin-like projections jutting out and catching on the top rim of the cylindrical holder.

3. An anti-crime device attachable to the obverse side of a furred, piled, and other garments and articles, and that is harmless to the wearer or user of such garments and articles but stings and injures anyone who forcefully touches, holds, detains or attacks the wearer and user thereof, said device comprising, in combination, the followings:

(a) a spike-needle having its bottom section made in the shape of a lower part of a small spike, its upper section made to taper off like a sharp needle, and its bottom end securely atached to the center of (b) a button-shaped base having holes large enough for a sewing needle and thread to go through, (c) at least one curly hair-like resilient steel wire attached to the said base, and rising upward while encircling the spike-needle and terminating at a point about one and one third times the height of the said spike-needle, said device being attachable to the obverse side of a furred and piled coats and other garments and articles with needle and thread.

4. An anti-crime device attachable to the obverse side of furred, piled and other garments and articles, and that is harmless to the wearer and user thereof, but stings and injures anyone who forcefully touches, holds, detains or attacks the wearer or user thereof, said device comprising, in combination, the followings:

(a) a spike-needle having its bottom section made in the shape of a small rod and its upper section made to taper off gradually to a sharp needle-like point, and having its bottom end welded and securely attached to the center of (b) a cross-shaped base having each of the four ends of the cross bent 45 degrees downward and sharpened, and (c) at least one hair-like, resilient, steel wire attached to the arm of the cross, and rising and winding around the said spike-needle until it is about one and one-third the height of the said spike-needle, said device being attachable to the obverse side of a garment or article by causing the sharp points at the ends of the cross-shaped base to penetrate the garment or article and by bending the sharp points against the reverse side.

* * * * *